US005205082A

United States Patent [19]

Shendon et al.

[11] Patent Number: 5,205,082

[45] Date of Patent: Apr. 27, 1993

[54] WAFER POLISHER HEAD HAVING FLOATING RETAINER RING

[75] Inventors: Norm Shendon; Kenneth C. Struven, both of San Carlos; Robert J. Kolenkow, Berkeley, all of Calif.

[73] Assignee: Cybeq Systems, Inc., Menlo Park, Calif.

[21] Appl. No.: 811,568

[22] Filed: Dec. 20, 1991

[51] Int. Cl.[5] ..... B24B 1/00

[52] U.S. Cl. ..... 51/283 R; 51/284 R; 51/237 R; 51/216 LP; 51/129

[58] Field of Search ..... 51/283 R, 284 R, 216 LP, 51/216 T, 236, 237 R, 237 M, 129, 131.1, 131.2, 131.3, 131.4

[56] References Cited

U.S. PATENT DOCUMENTS 3,731,435 5/1973 Boettcher et al. ..... 51/129
4,270,316 6/1981 Krämer et al. ..... 51/283 R
4,519,168 5/1985 Cesna ..... 51/283 R
4,918,870 4/1990 Torbent et al. ..... 51/216 T
5,081,795 1/1992 Tanaka ..... 51/237 R

*Primary Examiner*—M. Rachuba
*Attorney, Agent, or Firm*—Flehr, Hohbach, Test, Albritton & Herbert

[57] ABSTRACT

A polishing head for polishing a semiconductor wafer is described. The head design enables a wafer retainer to float during polishing and yet extend beyond a wafer carrier to define a pocket for the wafer and thereby facilitate wafer changing. The head construction also enables the carrier to be selectively projected beyond the retainer so that the surface of the carrier is easily accessible for changing an insert or the like. The head uses a positive air pressure to press the wafer against the polishing pad and the head includes interfering mechanical constructions which provide the positions mentioned above.

21 Claims, 2 Drawing Sheets

LOAD

POLISH

CHANGE

WAFER POLISHER HEAD HAVING FLOATING RETAINER RING

BACKGROUND OF THE INVENTION

This invention relates to the polishing of semiconductor wafers of the type from which chips for integrated circuits and the like are made and, more particularly, to a polishing head for positioning such a wafer for the polishing of a face thereof by a procedure which includes engagement of the face with a polishing surface, and a method of such polishing.

Integrated circuits typically are provided as "chips", each of which includes a piece of flat material that has the desired circuitry. Typically, a multiple number of the desired integrated circuits are formed at the same time by etching and coating a disk-shaped semiconductor wafer substrate. This wafer is then diced into flat pieces which are individually provided with suitable packaging having the leads necessary to electrically access the integrated circuitry. These packaged pieces of material (dies) are referred to as integrated circuit chips. In certain instances, a full wafer is used to form a single integrated circuit rather than duplicates of a desired integrated circuit.

The disk-shaped wafer substrates typically are comprised of a monocrystalline semiconductor, such as single crystal silicon. One common method of forming the wafers is to grow a relatively long cylinder or log of a single crystal of the material, and then slice the log (often called a boule) to form the individual disk-shaped wafers. It should be noted that while by far the greatest use of semiconductor wafers is as substrates for integrated circuitry, there are other uses, e.g., as solar cells.

It is necessary for the formation of various circuits or for other uses of wafers, that the active or front face, e.g., the face of the wafer on which the integrated circuitry is to be formed, be highly polished. (The other side of the wafer is often referred to as the wafer "back" face.) To this end, polishing machines have been designed to provide the desired finish. These machines typically bring the face of the wafer to be polished into engagement with a treating surface, such as the polishing surface of a rotating polishing pad having a desired polishing material, e.g., a slurry of colloida silica, applied thereto. In many instances, the polishing head which holds the wafer with the face exposed also rotates. It is the movement between the wafer and the polishing pad which results in the desired polishing. In some instances this "polishing" is provided primarily for the purpose of making one face flat, or parallel to another face. In this connection, it must be remembered that the wafer itself is monocrystalline, and characteristics of this type may be quite important in making the same suitable for the production of integrated circuitry or for some other desired use.

It will be recognized that the engagement of the face of the wafer and the polishing pad moving relative thereto will result in a lateral force being applied to the wafer tending to move the same in an uncontrolled manner. It is desirable that there be no uncontrolled movement, though, to provide the degree of control to the polishing process that is required. This problem is particularly acute in machines designed to polish a multiple number of wafers at the same time, as opposed to providing single wafer polishing. Reference is made, for example, to U.S. Pat. No. 4,918,870, which describes the use of "floating" subcarriers to enable the benefits of single wafer polishing to be achieved with the economies of multiple wafer polishing.

Carriers for wafers to be polished often have included wafer-holding inserts and/or retainers which define pockets for holding the wafers in a set position. The difficulty is that such an insert or retainer interferes with the polishing of the exposed wafer face. The insert or retainer is itself held against the polishing pad, and although it holds the wafer in a desired position its own surface and thickness characteristics deleteriously affect the wafer face polishing.

SUMMARY OF THE INVENTION

The present invention provides a polishing head having a retainer connected to the wafer carrier in such a way that it floats on a polishing surface during the polishing process but yet projects beyond the carrier to form the desired pocket to facilitate wafer loading. In other words, the edge retainer is allowed to move if necessary when engaged with the polishing pad to accommodate angular variations between the wafer face and the polishing pad surface. However, the position of the edge retainer is fixed when the wafer face is not in engagement with the polishing surface so as to define the desired wafer pocket.

In a preferred arrangement, the invention uses positive air or other fluid pressure to press the wafer against the polishing surface for the polishing. The result is that the wafer "floats" relative to such surface during the polishing operation, i.e., it will be moved against the air pressure to the extent necessary to accommodate relatively large variations in the distance between the head and polishing surface. In keeping with the invention, the retainer floats independent of the wafer during the polishing operation. Moreover, interfering mechanical construction means is provided to counteract the pressure differential which results in the float to enable the retainer to project beyond the remainder of the carrier and define the desired wafer pocket. The definition of a pocket during such time greatly facilitates replacing polished wafers with unpolished ones, i.e., loading the machine. This operation typically takes place every ten minutes or so.

The manner in which a wafer is adhered to the polishing head of the invention for the polishing operation is typical, in that the portion of the carrier defining the bottom surface of the wafer pocket includes an insert which provides wafer adherence. Such inserts often are a sheet of resilient poromeric polyurethane film which when wet causes the back face of a wafer to be removably adhered thereto, thereby leaving the wafer front face exposed for the polishing operation. As is known, carrier inserts of this nature must be changed periodically, e.g., once a day.

Means also most desirably is included as part of the inventive combination to project the portion of the carrier defining the bottom surface of the pocket beyond the retainer. The result is that the retainer does not interfere with removal of the insert and the insert changing operation is facilitated.

In the preferred implementation which is described, the retainer is annular and circumscribes the carrier portion to define a pocket for a disk-shaped wafer. A flexible membrane acts as the connector discussed above to allow the retainer to float during polishing and yet project beyond the carrier to form the pocket. The interfering mechanical construction means has two differing positions, the first of which provides interference of movement of the carrier relative to the retainer in response to the pressure differential to cause the retainer to project beyond the carrier and define the pocket, and a second of which when active interferes with the movement to cause projection of the carrier beyond the retainer.

The method of the invention includes allowing the edge retainer to move during polishing in order to accommodate angular variations between the wafer face which is being polished and the polishing surface, and fixing the position of the wafer edge to define the wafer pocket at a time when the wafer face is not in engagement with the polishing surface. Most desirably it further includes the step of selectively projecting the carrier portion beyond the retainer.

Other features and advantages of the invention either will become apparent or will be described in connection with the following, more detailed description of preferred embodiments of the invention.

BRIEF DESCRIPTION OF THE DRAWINGS

With reference to the accompanying 2 sheets of drawing.

DESCRIPTION OF THE PREFERRED EMBODIMENT(S)

The following relatively detailed description is provided to satisfy the patent statutes. However, it will be appreciated by those skilled in the art that various changes and modifications can be made without departing from the invention as defined by the claims and their equivalents.

Figure 1:
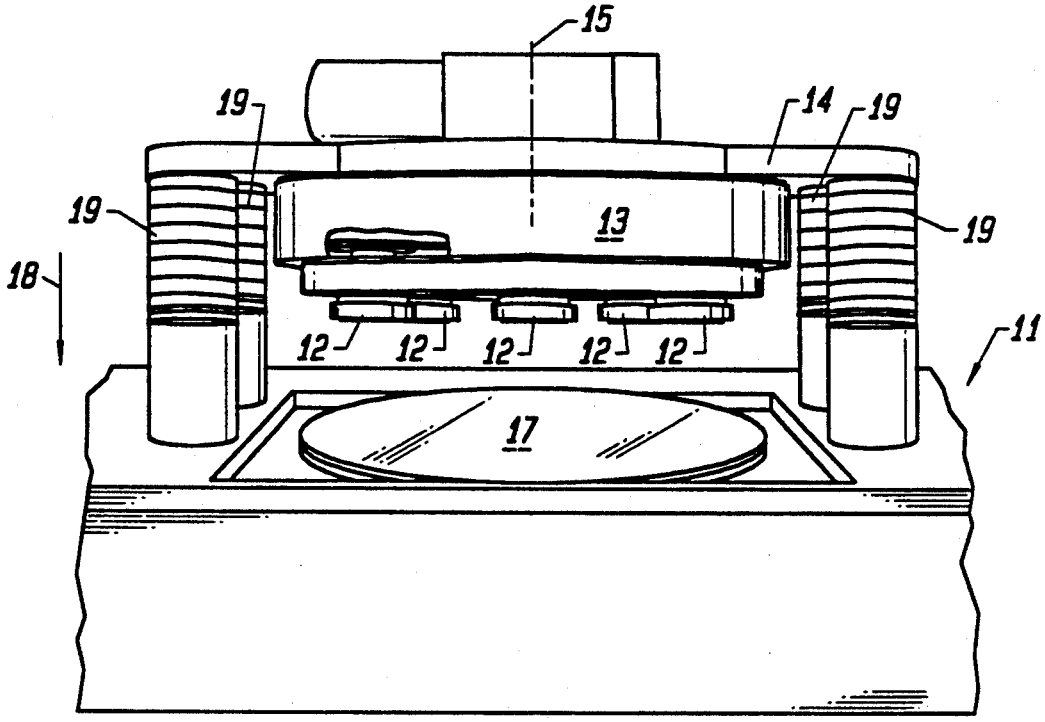
FIG. 1 is a generally diagrammatic view illustrating the relevant components of a wafer polishing apparatus having a plurality of polishing heads of the invention.

With reference to FIG. 1, a polishing apparatus, generally referred to by the reference numeral 11, is illustrated having a plurality (6 in one implementation of the invention) of polishing heads, each of which is designed to hold one disk-shaped, semiconductor wafer for the polishing of an exposed face of the same. Each of the heads 12 is mounted on a disk-shaped carousel 13 suspended from a bridge 14 to which it is mounted for rotation about its central axis 15. The heads 12 are equally spaced from one another and are mounted in a circular pattern on carousel 13. Such heads are all connected together via a chain drive, for example as illustrated. The combined rotation of the carousel and the rotation of the heads with respect to the carousel results in a planetary motion of any wafer held by a head.

A polishing pad 16 providing a polishing surface 17 is mounted for rotation beneath the carousel 13 and the heads 12. The exposed faces of wafers held by the heads are brought into engagement with the polishing surface 17 by translational movement of the carousel in the direction of the arrow 18 by screw drives (not shown) within bellows 19. The compound rotary motion provided by the rotation of the pad, the carousel and the heads results in the desired polishing.

Figure 2:
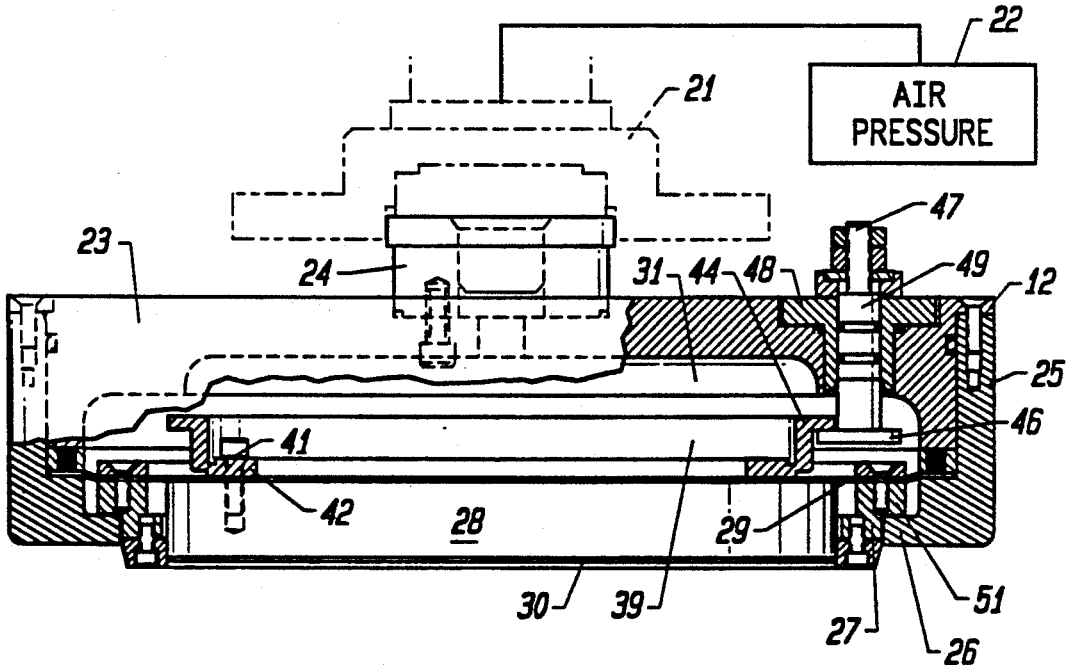
FIG. 2 is a sectional view of a preferred embodiment of the polishing head.

FIG. 2 is a broken-away and sectional view of one of the heads 12. The spindle which mounts the same is illustrated in phantom lines at 21 and a schematic representation of means for providing positive air pressure within the interior of the head is represented at 22.

The head 12 is discular in shape and includes an upper exterior main machined part 23 which provides the desired mounting to spindle 21 via a central coupler 24. An annular side machined part 25 circumscribes the main part 23 and is rigidly attached thereto. Such side part includes an inwardly directly annular flange 26 which circumscribes a wafer retainer represented at 27. Such retainer circumscribes, in turn, a disk-shaped wafer carrier 28. The principal purpose of the retainer 27 is to resist the lateral force on a disk-shaped wafer held by the carrier, caused by engagement of the face of the wafer to be polished with the polishing pad surface. An insert 30 is provided on the surface of the carrier at which at wafer is to be adhered. In accordance with conventional practice, this insert covers the full surface of the carrier. As is illustrated and will be discussed in more detail below, a connector in the form of a flexible but impermeable diaphragm 29 connects the carrier 28 and the retainer 27. Such diaphragm is secured adjacent its edge to the remainder of the head by being sandwiched between the main and side parts 23 and 25, respectively. The means 22 provides a pressure differential between the two volumes on opposite sides of the membrane 29. That is, the air pressure within the volume 31 defined within the head is maintained at a slightly positive pressure relative to atmospheric, e.g. 1–10 psi gauge pressure, and the side of the membrane 29 on which the carrier 28 is provided is subjected to ambient atmospheric pressure.

It will be recognized that the result of the pressure differential on opposite sides of the flexible diaphragm will be that the diaphragm will tend to move to expand the volume 31, i.e., move downwardly in the drawing. In keeping with the invention, though, interfering mechanical construction means are provided to counteract the pressure differential at desired locations. Such means includes an annular flange ring 39 which is secured through such diaphragm to the carrier 28, via a plurality of bolts (one of which is shown at 41) extending through an inwardly directed flange 42 thereof. As illustrated, ring 39 includes an outwardly directed shelf or flange 44 which is engageable by a stop disk 46 on the end of the rod construction 49 opposite a threaded end 47. The rod 49 passes in a hermetic manner axially through an insert 48 which, in turn, passes through the main head part 23. While only one insert with its rod assembly, etc. is illustrated, it is preferred that a plurality of the same be provided spaced equally about the head for engagement with the ring 39 in the manner illustrated—in one implementation, 3 were provided, spaced equally from one another about the head.

The interfering mechanical construction further includes an annular projection 51 as part of the retainer. Such annular projection is positioned to engage the inwardly directed flange 26 on the edge component 25 and thus prevent movement of the carrier beyond the position illustrated in FIG. 2.

Figure 4:
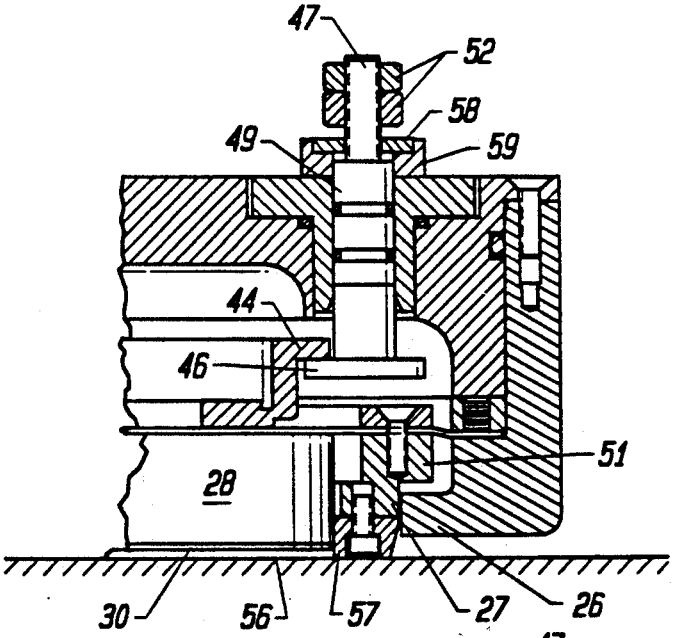
FIG. 4 is a view similar to FIG. 3 illustrating the relationship of the parts during polishing.
Figure 5:
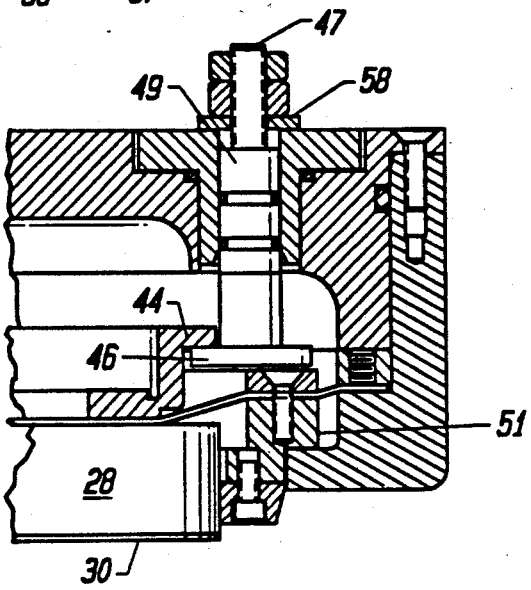
FIG. 5 is another view similar to FIG. 3 showing the relationship of the parts when the carrier projects beyond the retainer.

The interfering mechanical construction means counteracts the pressure differential formed on opposite sides of the diaphragm 29 to provide the desired positional relationships between the carrier and retainer. Moreover, it enables the carrier and retainer to "float" during the polishing operation, i.e., move freely about to equalize the pressure applied by the head to the wafer during the polishing operation. Reference is made to FIGS. 3 through 6 for an understanding of the various positions. There are, in essence, three positions, the load position (FIG. 3), the polish position (FIG. 4), and the insert change position (FIG. 5). The load position is one in which the retainer projects beyond the carrier to form a pocket for a disk-shaped wafer to facilitate application of such wafer to the carrier. The polish position is one in which the retainer floats relative to the carrier and the wafer during the actual polishing operation. The insert change position is one in which the interfering mechanical construction projects the carrier beyond the retainer to facilitate changing of an insert 30 or access to the carrier surface for any other purpose. With reference to such FIGS. 3–6, the projecting ring 51 on the retainer engages the inwardly directed flange 26 of the edge component 25 to limit the extent to which the retainer 27 projects downward as viewed in the drawing when there is no upward pressure on the same. (There is upward pressure on the same during the polishing operation shown in FIG. 4.) At the same time, the carrier 28 is held in a position upwardly relative to such retainer by engagement of the flange ring 44 with the end disk 46.

As mentioned previously, disk 46 is on the end of rod 49. Its position is adjustable from the exterior of the head by appropriate rotation of the nuts 52 on the threaded end 47 of the rod 49. It should be noted that this exterior adjustment of what happens inside the head facilitates such adjustment.

Figure 3:
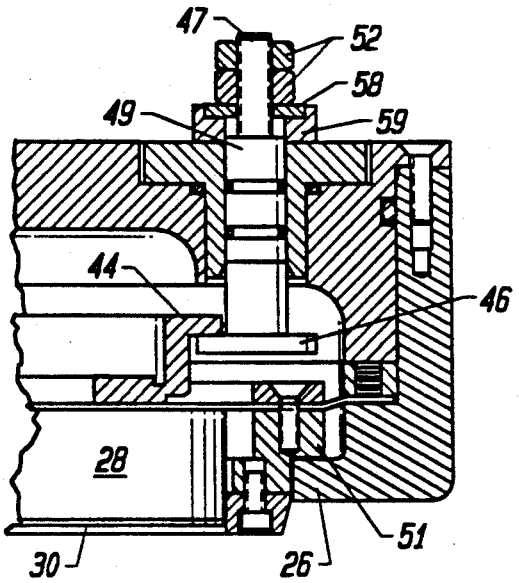
FIG. 3 is a partial sectional view illustrating the relationship of the parts when the retainer extends beyond the carrier to define a pocket for a wafer.

The carrier 28 is positioned relative to the retainer in FIG. 3 to form a pocket for the wafer. This facilitates application of the wafer to such carrier. That is, the location on the carrier for the wafer will be quite well defined. With reference to such figure, it will be seen that the projection of the retainer beyond the carrier results in the desired wafer pocket being defined. The insert 30 is glued on the bottom surface of the pocket. Such insert will provide adherence to the back face of a wafer to be polished.

The load position illustrated in FIG. 3 shows the relationship of the carrier and retainer which will automatically be formed with the full construction described whenever the polishing head is not in engagement with the polishing surface, e.g., when the head 12 is raised with the carousel 13. FIG. 4 illustrates the relationship during the polishing operation. The carrier 28 will bring a wafer represented by the reference numeral 56 into engagement with the polishing surface. The retainer 27 also will be in engagement with such polishing surface. In this connection, the retainer includes a ring 57 of acetal plastic or similar material to engage the moving polishing surface. This ring and the remainder of the retainer will float with the wafer during the polishing operation. That is, sufficient pressure is applied to the head 12 to raise the retainer to disengage the projecting shelf 51 from its engagement with the flange 26. Such pressure will, of course, also raise the carrier 28. As illustrated in FIG. 4, rod 49 will move upward as necessary to accommodate such pressure.

It will be appreciated that the above relationship is one in which the interfering mechanical construction is inoperative. The carrier 28 and retainer 27 will float during the polishing operation. That is, each will be able to independently move to a meaningful extent along three differing orthogonal axes—X, Y and Z. Thus, slight tipping and/or raising or lowering of the retainer is permitted as is necessary to accommodate the wafer polishing. It should be noted that the flexible membrane connecting the retainer, the carrier, and the remaining body of the head permits such movement. It also allows the floating relationship of the carrier and retainer illustrated in FIG. 3.

Figure 6:
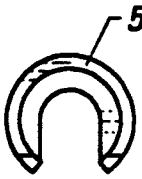
FIG. 6 is a top elevation view of a C-shaped washer portion of the preferred embodiment.

As mentioned previously, it is desirable to periodically replace the wafer adhering insert within the pocket of a carrier. FIGS. 5 and 6 illustrate a position of the interfering mechanical construction which results in the carrier projecting beyond the retainer to facilitate such changing. In this connection, at the exterior of the carrier, the rod 49 passes through a pair of washers 58 and 59. As can be seen from FIG. 6, washer 59 is a so-called "C" washer having both a depression for receipt of the washer 58 and a slot enabling the same to be easily removed from about rod 49. Its removal results in the interfering mechanical construction provided by the disk 46 and the flange ring 44 enabling the membrane 29 to respond to the pressure within cavity 31 by extending carrier 28 beyond the retainer. This position of the assembly is illustrated in FIG. 5. Thus, it is a simple matter for an operator to gain the access to the insert and its securance to the carrier for removal of the insert without the retainer interfering with the same.

Thus, the "C" washer 59 acts as means for determining whether the interfering mechanical construction provides the position illustrated in FIG. 3 or that provided in FIG. 5. Moreover, it is positioned to be selectively manipulatable from the exterior of the head to facilitate insert changing. This ability to make a simple manipulation on the exterior of the head to place the carrier in position for insert changing has been found to be a great saver of time.

It will be seen from the above that the method of the invention includes allowing the edge retainer to move during its polishing engagement with the polishing surface while fixing its position to define the wafer pocket at a time when the head is retracted from the polishing pad. It further includes electively projecting the carrier beyond the retainer. All of these operations are easily achieved because the membrane secures the carrier to the retainer and the retainer to the remainder of the head. In this connection, it should be noted that the flexible membrane performs a dual function, in the sense that it provides the flexing necessary for movement of the carrier with respect to the retainer and remainder of the head, as well as the flexing necessary to allow the retainer to move with respect both to the carrier and the remainder of the head.

As mentioned at the beginning of the detailed description, applicants are not limited to the specific embodiment(s) described above. Various changes and modifications can be made. For example, it will be appreciated that differing interfering mechanical constructions can be provided to obtain the ends of the invention. The claims, their equivalents and their equivalent language define the scope of protection.

What is claimed is:

1. A polishing head for positioning a semiconductor wafer for the polishing of a face thereof by a procedure which includes engagement of said face with a polishing surface, comprising:

(a) a carrier for a wafer;

(b) a retainer for resisting lateral force on a wafer caused by engagement of the face thereof with said polishing surface during the polishing of said face, which retainer engages said polishing surface with said wafer during the polishing of said face; and (c) a connector between said carrier and said retainer allowing the latter both to float on said surface while said wafer face is polished and to project beyond said carrier to form a pocket therewith for a wafer to facilitate application of the same to said carrier.

2. The polishing head of claim 1 wherein said retainer encloses a portion of said carrier with which it defines said pocket, further including means for selectively projecting said portion beyond said retainer.

3. The polishing head of claim 2 wherein said portion includes an insert to adhere said wafer within said pocket.

4. The polishing head of claim 1 wherein said connector is a flexible membrane.

5. The polishing head of claim 4 wherein said flexible membrane is positioned to respond to a pressure differential between two volumes on opposite sides of the same, means are provided for forming said pressure differential to cause said float during said engagement, and interfering mechanical construction means is provided to counteract said pressure differential to provide said retainer projection and consequent wafer pocket.

6. The polishing head of claim 5 further including means for changing the location at which said interfering mechanical construction means counteracts said pressure differential.

7. The polishing head of claim 6 wherein said means for changing said location is positioned to be accessible from the exterior of said head.

8. The polishing head of claim 5 wherein said interfering mechanical construction means has a first position in which it overcomes said pressure differential and allows said retainer to project beyond said carrier to form a pocket therewith and a second position at which said carrier projects beyond said retainer.

9. The polishing head of claim 8 further including means for determining whether said interfering mechanical construction provides said first or said second position.

10. The polishing head of claim 9 wherein said means for determining is positioned to be manipulatable from the exterior of said head.

11. The polishing head of claim 4 or of claim 5 wherein said membrane also provides means for selectively projecting said carrier beyond said retainer.

12. In a method of using an edge retainer on a semiconductor wafer carrier to define a pocket for a wafer to resist lateral forces which may be applied to such wafer during the treatment of a face thereof which includes engagement of said face with a treating surface, the steps of:

(a) allowing said edge retainer to move during said engagement to accommodate angular variations between said wafer face and said treating surface; and (b) fixing the position of said edge retainer to define said wafer pocket at a time that said face is not in engagement with said treating surface.

13. The method of claim 12 wherein said step of allowing said edge retainer to move includes allowing the position of the same to float during said engagement.

14. The method of claim 13 wherein said retainer encloses a portion of said carrier with which it defines said pocket, further including the step of selectively projecting said portion beyond said retainer.

15. The method of claim 12 wherein a flexible membrane connects said retainer and said carrier, which membrane is positioned to respond to a pressure differential on opposite sides of the same and means are provided for forming said pressure differential, and wherein said step of allowing said edge retainer to move during said engagement includes allowing said engagement to overcome said pressure differential and flex said membrane.

16. The method of claim 15 wherein said step of fixing the position of said edge retainer includes providing interfering mechanical construction means to counteract said pressure differential.

17. The method of claim 16 wherein said retainer encloses a portion of said carrier with which it defines said pocket, further including the step of selectively projecting said portion beyond said retainer.

18. The method of claim 17 wherein said step of selectively projecting said portion beyond said retainer includes changing the location at which said interfering mechanical construction means counteracts said pressure differential.

19. A polishing head for positioning a semiconductor wafer for the polishing of a face thereof by a procedure which includes engagement of said face with a polishing surface, comprising:

(a) means for carrying said water, said carrying means including an edge retainer to define a pocket for said wafer;

(b) means for allowing said edge retainer to move during said engagement to accommodate angular variations between said wafer face and said polishing surface; and (c) means for fixing the position of said edge retainer to define said wafer pocket at a time that said face is not in engagement with said polishing surface.

20. A polishing head for positioning a disk-shaped semiconductor wafer for the polishing of a face thereof by a procedure which includes engagement of said face with the polishing surface of a polishing pad, comprising:

(a) a carrier having a portion for holding a disk-shaped wafer with a face thereof to be polished exposed;

(b) an annular retainer for circumscribing said portion, defining therewith a pocket for a disk-shaped wafer, and for resisting lateral force on a wafer in said pocket caused by engagement of said face with said polishing surface during the polishing of said face, which retainer engages said polishing surface with said wafer during the polishing of said face;

(c) a flexible membrane connecting said carrier and said retainer positioned to respond to a pressure differential between two volumes on opposite sides of the same;

(d) means for forming said pressure differential and cause said retainer to float on said polishing surface while said wafer face is being polished; and (e) interfering mechanical construction means to overcome said pressure differential and allow said retainer to project beyond said carrier to form a pocket therewith for a wafer.

21. The polishing head of claim 20 further including an insert within said pocket for adhering said wafer to said carrier; wherein said interfering mechanical construction means has a first position in which it overcomes said pressure differential and allows said retainer to project beyond said carrier to form a pocket therewith and a second position at which said carrier projects beyond said retainer to facilitate the changing of said insert without interference by said retainer; and further including means accessible from the exterior of said carrier for changing the location at which said interfering mechanical construction means overcomes said pressure differential.

* * * * *